US006317986B1

(12) United States Patent
Huang

(10) Patent No.: US 6,317,986 B1
(45) Date of Patent: Nov. 20, 2001

(54) QUICK DISASSEMBLY DEVICE FOR A HEAVY DUTY ARTISTIC CUTTER

(76) Inventor: Yin-Hae Huang, No. 56, Min Sheng Street, Feng-Yuan City (TW), 42041

( * ) Notice: Subject to any disclaimer, the term of this patent is extended or adjusted under 35 U.S.C. 154(b) by 0 days.

(21) Appl. No.: 09/575,500

(22) Filed: May 18, 2000

(51) Int. Cl.[7] ..... B26B 1/08
(52) U.S. Cl. ..... 30/162; 30/335
(58) Field of Search ..... 30/162, 335, 151, 30/329

(56) References Cited

U.S. PATENT DOCUMENTS 3,007,244 * 11/1961 De Vern Austin ..... 30/335
5,121,544 * 6/1992 Gilbert ..... 30/162
5,862,596 * 1/1999 Chung ..... 30/162
6,163,963 * 12/2000 Huang ..... 30/162

* cited by examiner

*Primary Examiner*—Hwei-Siu Payer

(57) ABSTRACT

A quick disassembly device for a heavy duty artistic cutter includes a handle combined with a pair of first and second half casings. The first half casing has a reduced end insertible into a vertical slot at a corresponding end of the second half casing. A circular depression is formed in the other end of each of the half casings including different slot in their bottoms for respectively engaging with rectangular latch and a positioning post from a fastener which fastens the two half casings together, a rectangular depression including a blade entrance in the top of the handle for slidably disposing a slidable blade rack therein.

1 Claim, 5 Drawing Sheets

QUICK DISASSEMBLY DEVICE FOR A HEAVY DUTY ARTISTIC CUTTER

BACKGROUND OF THE INVENTION

The present invention relates to artistic cutters and more particularly to a heavy duty artistic cutter which has a quick disassembly device on its handle for the rapid chance of the blade from the handle therewithin.

Typical heavy duty artistic cutter has a handle combined by a pair of half casings and connected with screws. Because of that the blade adapted to this cutter is of double headed. Each time, when changing the blade, one must unfastens the screws and disassembles the handle apart. This process always consumes a lot of time for the user. Some of the automatic disassembling handle for the cutter is therefore available. But they sacrifice the stable combination of the handle so as to affect the use of the cutter.

SUMMARY OF THE PRESENT INVENTION

The present invention has a main object to prove a quick disassemble device for a heavy duty artistic cutter which has a handle is readily disassembled but not stability of the use of the cutter.

Accordingly, the heavy duty artistic cutter has a handle which is combined by a pair of half casings without using a screw but a quick disassemble device which includes a sleeve formed on one end and a button on the other end of the handle. The button has a locking member made incorporation with the corresponding recess in the handle. So that when rotates the button clockwise the handle is combined and when rotates the button counterclockwise, the handle is disassembles. This process is worked readily and promptly.

The present invention will become more fully understood by reference to the following detailed description thereof when read in conjunction with the attached drawings.

DETAILED DESCRIPTION OF THE PREFERRED EMBODIMENT

Figure 1:
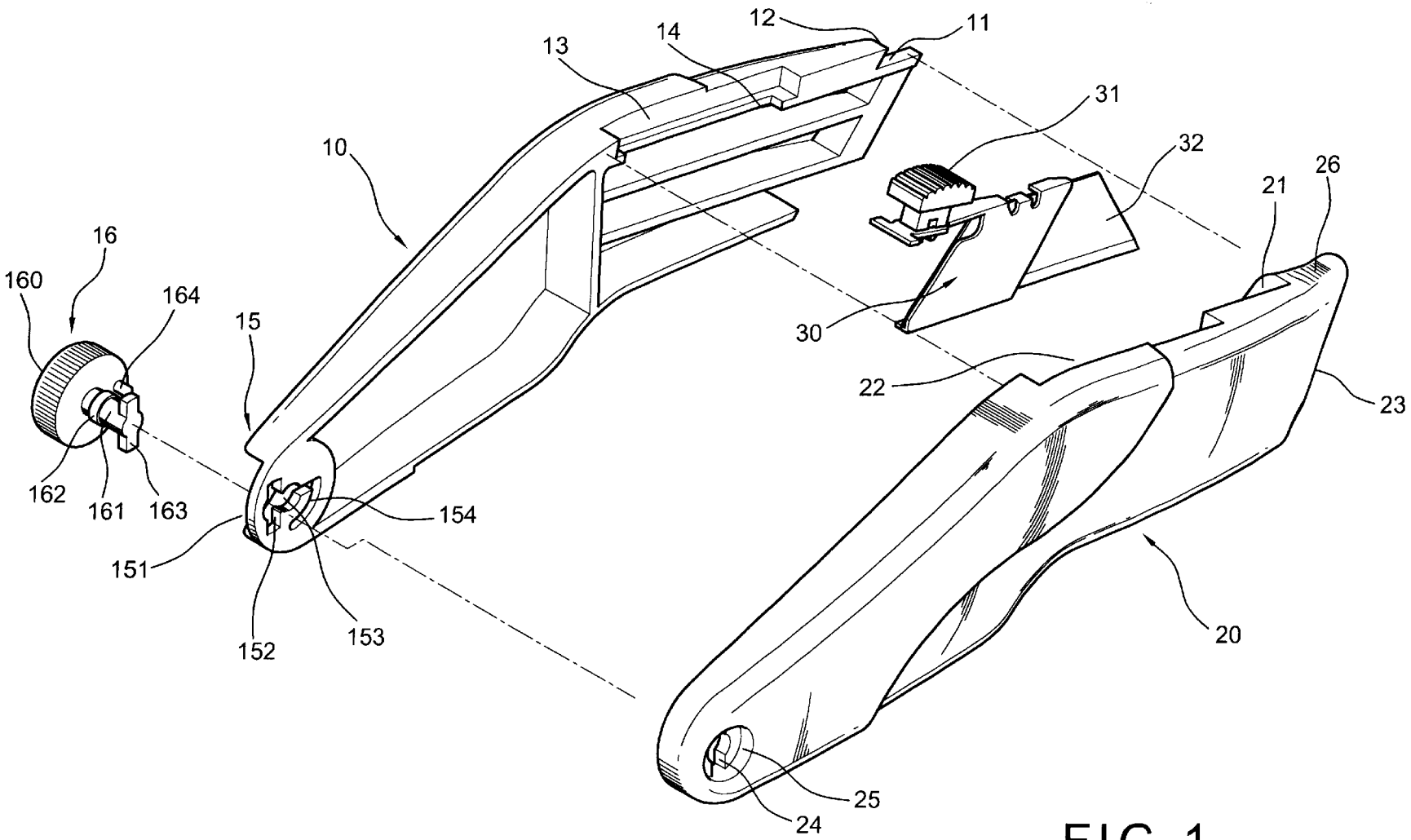
FIG. 1 is an exploded perspective view to show the preferred embodiment of the heavy duty artistic cutter according to the present invention.
Figure 2:
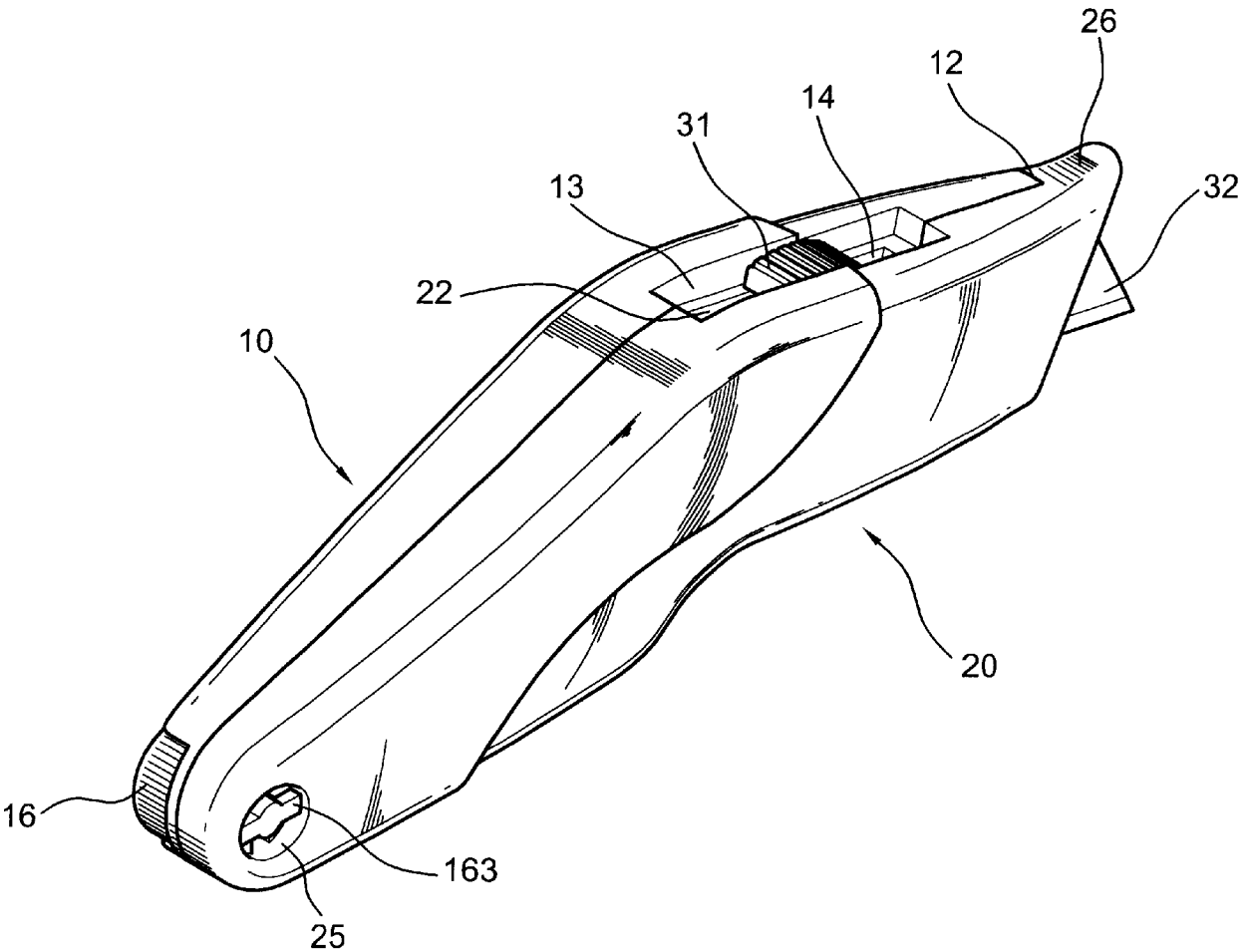
FIG. 2 is a perspective view to show an assembly of FIG. 1.
Figure 3:
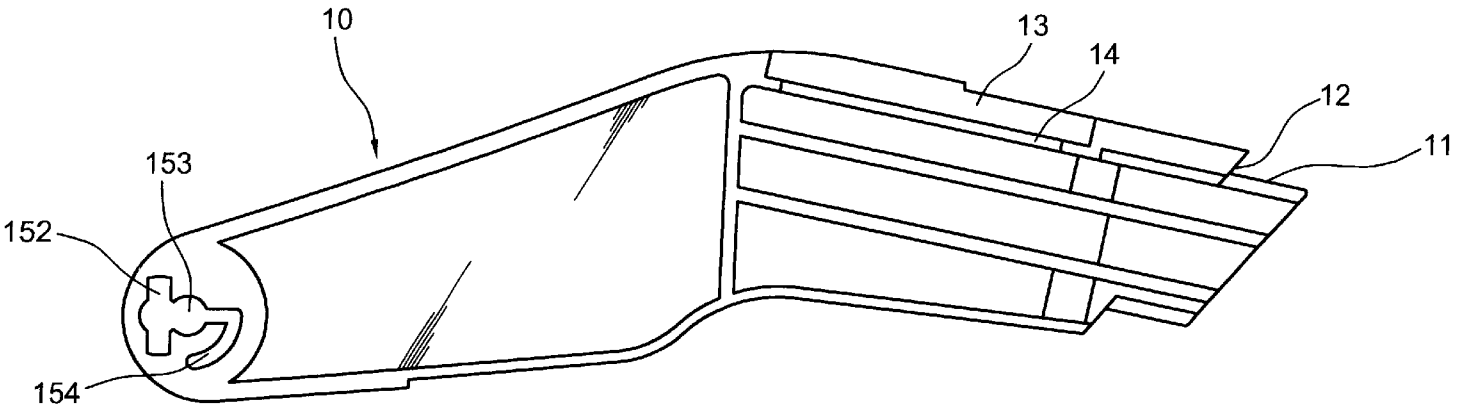
FIG. 3 is a side view of a first half casing of the handle of the cutter.
Figure 4:
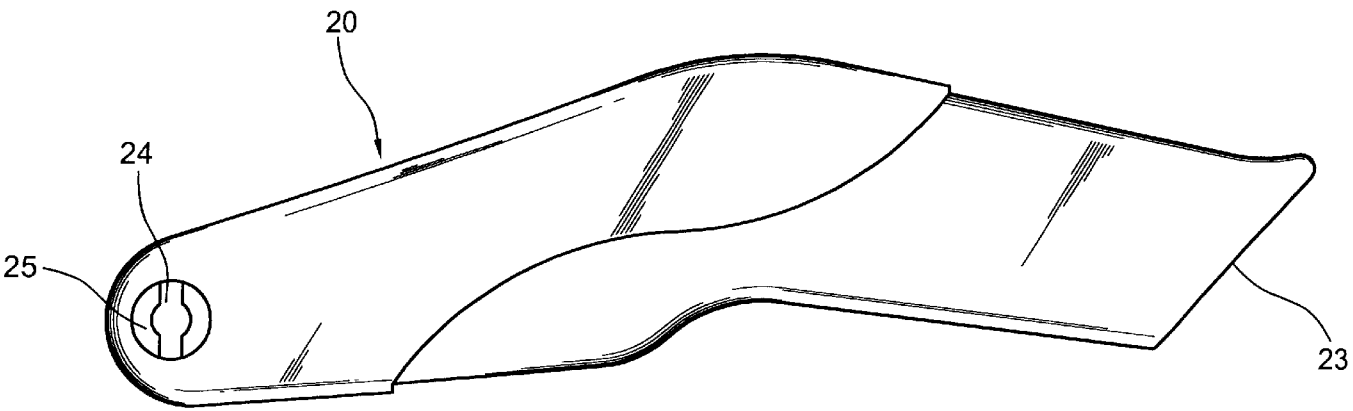
FIG. 4 is a side view of a second half casing of the handle of the cutter.

With reference to FIGS. 1, 2, 3 and 4 of the drawings, the heavy duty artistic cutter of the present invention comprises generally a handle combined with a first half casing 10 and a second half casing 20, and a slidble blade rack 30.

The first half casing has a reduced front end 11, a first shoulder 12 abutting the front end 11, a first rectangular depression 13 in a top, a blade entrance 14 under the depression 13, a first circular depression 15 in an outer surface abutting the rear end including a notch 151 in a circumference, a rectangular slot 152 in the bottom of the depression 15 adjacent an outer circumference of the depression 15 having an arcuate portion in the center, a circular slot 153 in the center of the bottom communicating to the rectangular slot 152 and an arcuate slot 154 adjacent an inner circumference of the depression 15 having a straight portion communicating to the circular slot 153.

The second half casing 20 has a second shoulder 21 engageable with the first shoulder 12, a second rectangular depression 22 engageable with the first rectangular depression 13, a vertical slot 23 in the front end for receiving the front head of the blade 32, a second circular depression 25 in an outer surface abutting the rear end made in registry with the bottom of the first circular depression 15 and rectanoular slot 24 including an arcuate central portion in the center of the second circular depression 25 and made in registry with the circular slot 153 of the first circular depression 15, and a thumbprint 26 on a top adjacent the front end.

A fastener 16 has a circular button 160, a cylindrical rod 161 centrally projected outward from an inner surface of the button 160 including an annular ring 162 on the root made engageable with the circular slot 153 and a pair of rectangular plates 163 symmetrically projected outward from the opposing peripheries of the rod 161 abutting the free end thereof made engageable with the rectangular slots 152 and 24 of the first and secondhalf casings, and a small post 164 projected outward from an inner surface between the circumference of the button 160 and the cylindrical rod 161 made slidably engageable into the arcuate slot 154 of the first circular depression 15.

The slidable blade rack 30 is of a conventional type and includes a slide 31 and a double headed blade 32.

Figure 7:
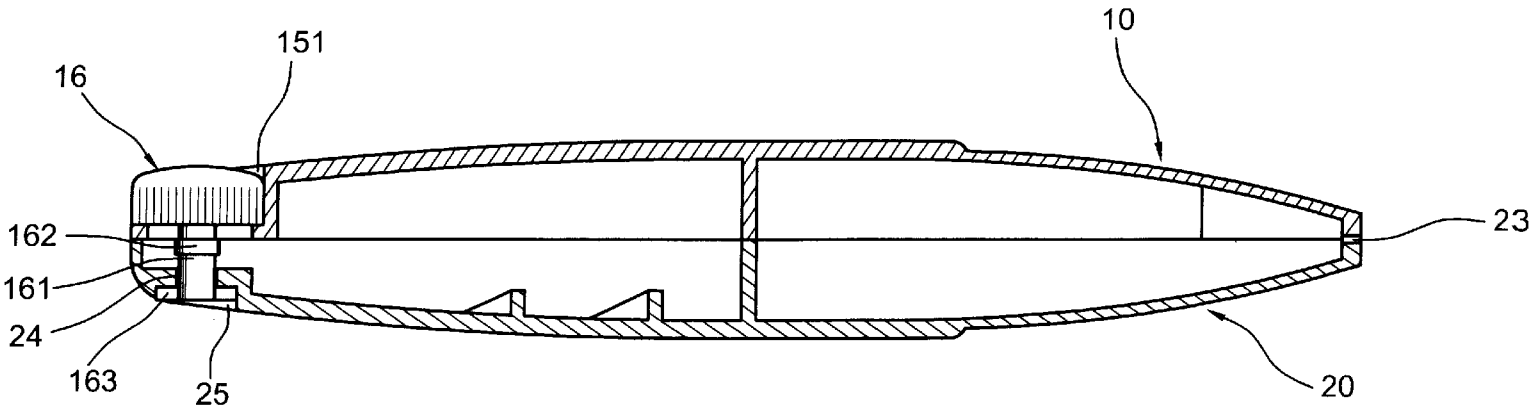
FIG. 7 is a top view of the quick disassembly device while the locking member is at a locking position.
Figure 8:
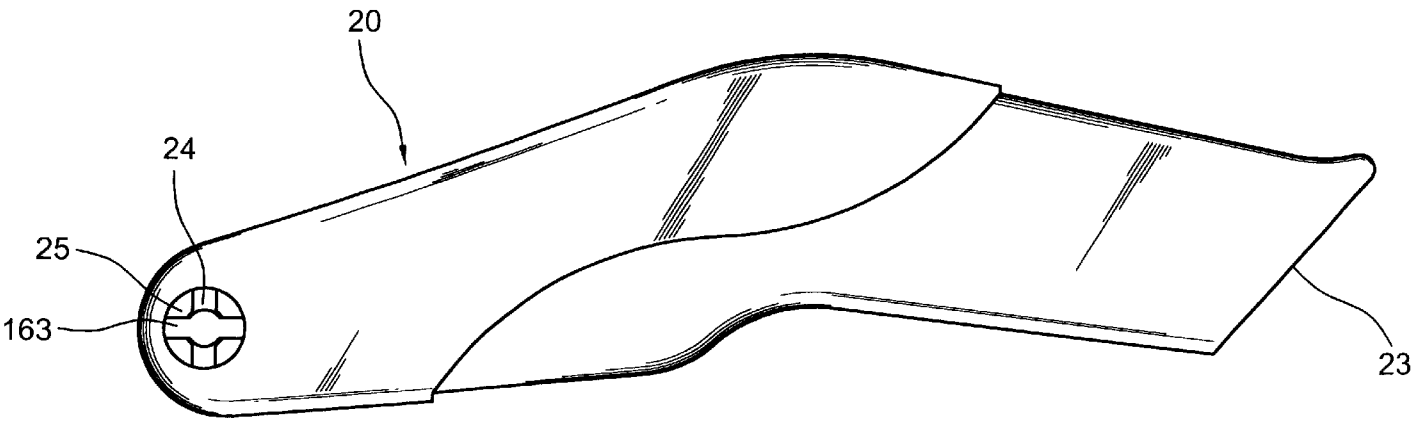
FIG. 8 is a side view of FIG. 7.

In combination, first insert the rectangular plates 163 of the fastener 16 into the rectangular slot 152 therethrough and centrally move the cylindrical rod 161 to have the annular ring 162 engaged into the circular slot 153, then the small post 164 is therefore moved to a position engageable into the arcuate slot 154 and the button 160 is placed into the first circular depression 15. Secondly, sleeve the vertical slot 23 of the second half casing 20 onto the reduced front end of the first half casing 10 so that the second shoulder 21 is stopped against the first shoulder 12, then engage the second rectangular slot 24 of the second half casing 20 with rectangular plates 163 of the fastener 16 and to have the rectangular plates 163 passing through the second rectangular slot 24, and then rotate the button 160 counterclockwise, the second half casing 20 is stably combined with the first half casing 10. The small post 164 which is provided to limit the span of the rotation of the button 160 now is moved to the upper end of the arcuate slot 154 (as shown in FIGS. 7 and 8). The blade rack 30 is placed into the second half casing 20 prior to the combination of the casings 10 and 20. Its slide 31 is remained to outside of the casings 10 and 20 in order to be slidable in the rectangular depression 13 and 22. Further, the small post 164 has also a function to prevent the annular ring 162 from disengaging with the circular slot 153 so as to promise a stable combination of the half casings 10 and 20.

Figure 5:
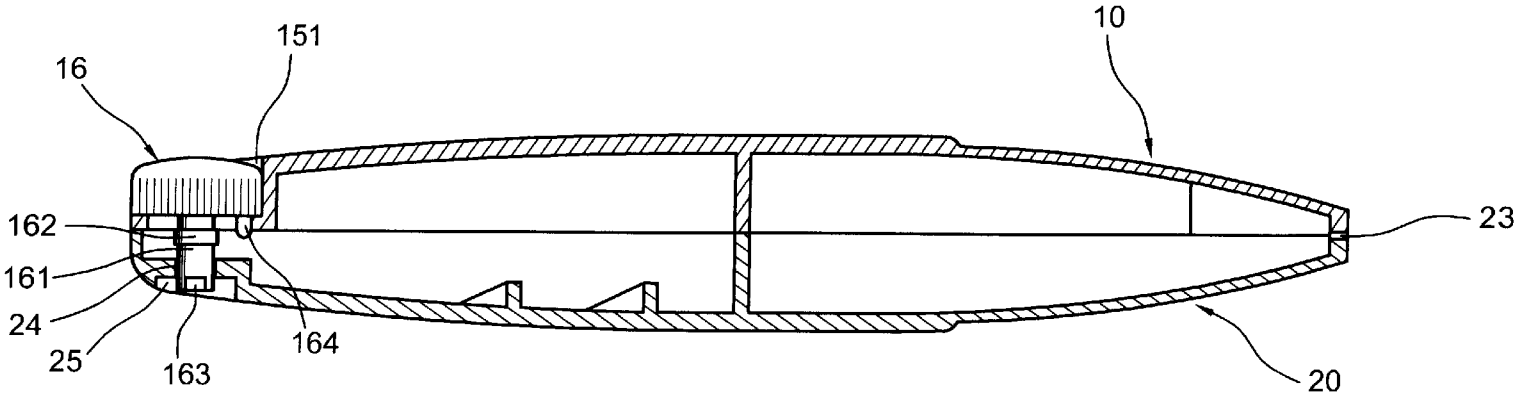
FIG. 5 is a top view of the quick disassembly device while the locking member is at an unlocking position.
Figure 6:
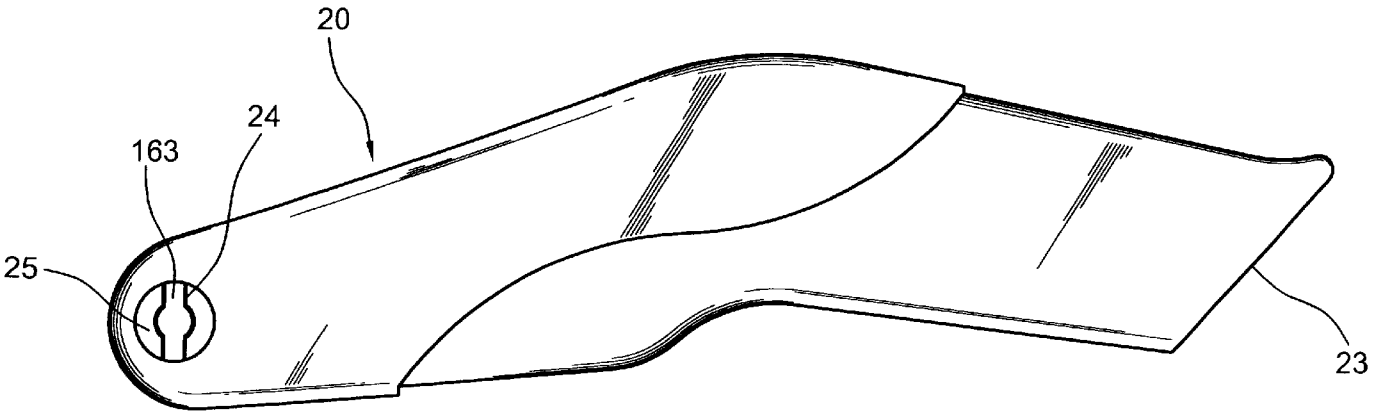
FIG. 6 is a side view of FIG. 5.

Referring to FIGS. 5 and 6, when rotates the button 160 clockwise, the small post 164 is moved to the lower end of the arcuate slot 154 and the rectangular plates are therefore in alignment with the second rectangular slot 24. So that the two half casing 10 and 20 are disassembled to facilitate the changing of a new blade.

The specification relating to the above embodiment should be construed as exemplary rather than as limitative of the present invention, with many variations and modifications being readily attainable by a person of average skill in the art without departing from the sprit or scope thereof as defined by the appended claims and their legal equivalents.

I claim:

1. A heavy duty artistic cutter comprising:

a handle combined with a first half casing and a second half casing;

said first half casing having a first end, a second end, a reduced portion at the first end to define a first shoulder thereabutting, a first rectangular depression in a top, a blade entrance under the first rectangular depression, a first circular depression in an outer surface abutting the second end including a notch in an outer periphery, a bottom inside the first half casing, a circular slot in center of the bottom, a rectangular slot having an arcuate central portion adjacent to an outer circumference of the bottom communicating to the circular slot and an arcuate slot adjacent to an inner circumference of the bottom communicating to the circular slot via a straight portion;

said second half casing having a first end, a second end, a vertical slot in the first end, a second shoulder adjacent the first end of said second half casing made engageable with the first shoulder of the first half casing, a second rectangular depression in a top made engageable with the first rectangular depression of the first half casing, a second circular depression in an outer surface adjacent the second end thereof and a second rectangular slot including an arucate central portion centrally formed in a bottom of the second circular depression made in registry with the circular slot of the first circular depression;

a fastener having a circular button rotatably disposed into the first circular depression of the first half casing, a cylindrical rod including an annular ring on a root centrally projected outward from an inner surface of the button made engageable with the circular slot of the first circular depression, a pair of rectangular plates symmetrically projected outward from opposing peripheries of the cylindrical rod abutting free end thereof made insertible through a first rectangular slot of the first circular depression and the second rectangular slot of the second circular depression, and a small post projected outward from an inner surface of the button between the annular ring and an inner circumference of the button made slidable within the arcuate slot of the first circular depression;

a slidable blade rack disposed into the handle having blade engageable into the vertical slot of the second half casing and a slide slidable with the second rectangular depression of the handle;

whereby, the half casings are combined when rotates the button counterclockwise and the half casings are disassembled when rotates the button clockwise.

* * * * *